US006132829A

United States Patent [19]

Kennerly et al.

[11] Patent Number: 6,132,829

[45] **Date of Patent: *Oct. 17, 2000**

[54] ARTICLES USEFUL SECURITY PRINTING AND METHODS OF MAKING THE SAME

[75] Inventors: William R. Kennerly, Arnold; Gordon C. Morison, Potomac, both of Md.; Julia J. Souther, Mauldin, S.C.; Kathy Alpaugh, Painesville, Ohio

[73] Assignee: Avery Dennison Corporation, Pasadena, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/864,571

[22] Filed: May 28, 1997

[51] Int. Cl.[7] ..... G09F 3/00

[52] U.S. Cl. ..... 428/40.1; 283/81; 428/41.8; 428/42.1; 428/42.2; 428/42.3; 428/43; 428/138

[58] Field of Search ..... 428/40.1, 41.8, 428/42.1, 42.2, 42.3, 43, 138; 283/81

[56] References Cited

U.S. PATENT DOCUMENTS

| | | | |
|---|---|---|---|
| 4,455,039 | 6/1984 | Weizen et al. | 283/83 |
| 4,809,912 | 3/1989 | Santini | 239/60 |
| 4,839,206 | 6/1989 | Waldenberger | 428/40 |
| 5,062,359 | 11/1991 | Giori | 101/152 |
| 5,080,973 | 1/1992 | Nguyen | 428/352 |
| 5,164,444 | 11/1992 | Bernard | 524/833 |
| 5,183,459 | 2/1993 | Bernard | 602/52 |
| 5,183,841 | 2/1993 | Bernard | 524/272 |
| 5,227,209 | 7/1993 | Garland | 428/42.1 |
| 5,248,544 | 9/1993 | Kaule | 428/195 |
| 5,264,532 | 11/1993 | Bernard | 526/261 |
| 5,312,680 | 5/1994 | Simpson | 428/40.1 |
| 5,385,965 | 1/1995 | Bernard et al. | 524/272 |
| 5,389,414 | 2/1995 | Popat | 428/40.1 |
| 5,431,763 | 7/1995 | Bradshaw | 156/256 |
| 5,449,200 | 9/1995 | Andric et al. | 283/67 |

FOREIGN PATENT DOCUMENTS 108208 5/1984 European Pat. Off. .

*Primary Examiner*—Naser Ahmad
*Attorney, Agent, or Firm*—Renner, Otto, Boisselle & Sklar

[57] ABSTRACT

This invention relates to an article useful as a substrate for security printing comprising a pre-cut facestock capable of being printed, a pressure sensitive adhesive having a first and second surface, and a release liner, wherein the first surface of the pressure sensitive adhesive is bonded to the facestock and the second surface is releasably bonded to the release liner, and wherein the bond strength of the releasable bond between the pressure sensitive adhesive and the release liner is greater than the temporary bonds formed with an ink and the printable surface of the facestock. The articles and methods of the present invention involve articles useful as facestocks for security printing. In one embodiment, the invention relates to the preparation and printing of stamps. An advantage of the present articles and methods is the use of articles with a pressure sensitive adhesive and a release layer, which do not lift off during printing. The bond strength of the releasable layer is greater than the temporary bonds formed with the ink and ink applicator during printing.

23 Claims, 1 Drawing Sheet

ARTICLES USEFUL SECURITY PRINTING AND METHODS OF MAKING THE SAME

TECHNICAL FIELD OF THE INVENTION

This invention relates to articles which are useful in security printing and methods of making the same. These articles are useful as pressure sensitive adhesive stamps.

BACKGROUND OF THE INVENTION

Stamps using pressure sensitive adhesives are self adhesive. Since their introduction consumers have found their use more convenient than gum based stamps. Many present stamp printers use gummed paper stock and do not have the equipment able to process pressure sensitive stocks. An investment in equipment and time for learning to process the pressure sensitive adhesive stock is required of a majority of printers. A first problem is that typical stamp printing equipment does not include the ability to die cut these materials. A second problem occurs when the articles are pre-cut because the stamps lift off during printing. The tackiness of the ink and the pressure of printing leads to separation of the stamp from the liner. A need exists for stocks which do not lift off during the printing process.

Security printing is used to prepare documents which have intrinsic value, such as stamps. These materials require precise printing to ensure the value of the printed articles. For instance, articles must be printed precisely to avoid counterfeiting. The printing is done to specific parameters and usually involves use of a registration system, e.g. printing marks, notches, etc.

A need exists for pressure sensitive printing stocks which (1) do not lift off during printing and/or (2) allow utilization of current printing technology without diecutting capability, e.g. gum stock processing equipment.

SUMMARY OF THE INVENTION

This invention relates to an article useful as a substrate for security printing comprising a pre-cut facestock capable of being printed, a pressure sensitive adhesive having a first and second surface, and a release liner, wherein the first surface of the pressure sensitive adhesive is bonded to the facestock and the second surface is releasably bonded to the release liner, and wherein the bond strength of the releasable bond between the pressure sensitive adhesive and the release liner is greater than the temporary bonds formed with an ink and the ink applicator. In another embodiment, the invention relates to a security printing stocks, methods of making articles useful as a substrate for security printing and pre-cut paper facestocks. In another embodiment, the article has a water soluble layer which allows separation of the facestock from the pressure sensitive adhesive.

The articles and methods of the present invention involve articles useful as facestocks for security printing. In one embodiment, the invention relates to materials useful in the preparation and printing of stamps. An advantage of the present articles and methods is that the use of pre-cut facestock do not lift off the release liner during printing. The bond strength of the releasable layer is greater than the temporary bonds formed between the ink and ink applicator during printing.

DETAILED DESCRIPTION OF THE PREFERRED EMBODIMENTS

As used in the specification and claims, the term "pre-cut" refers to articles which are die cut before applying ink (e.g. printing) to the article. The "pre-cutting" provides for separation of the printed article, such as separation of a stamp from the release liner. The "pre-cutting" may be by any means or combination of means known to those in the art and include, kiss cutting, microperforating, etc.

The term "temporary bonds" refers to the bonds formed during the printing process which occur as the ink is applied to the article. The temporary bonds refers to the bonds between the ink to the ink applicator. The inks used are those typical for the printing process. In one embodiment, the ink has a tack of at least about 15, or 16.

The term "printing" refers to any known printing process which may apply ink to the article. This term is intended to covers all forms of printing such as offset, intaglio, gravure, lithographic printing and combination of these processes.

The term "facestock" refers to the paper or polymer film articles which are useful as the printing surfaces.

The term "registration system" refers to a mark of surface on the article which serves as a guide for the detailed or security printing. The mark may also be a holographic image placed on the facestock. The registration system also include notches, holes, lines, etc. A combination of registration marks may be used to establish the registration system.

The articles of the present invention are pre-cut. They are useful for security printing such as in stamp printing. In one embodiment, the articles have a thickness from about 4 to about 15, or from about 6 to about 9, or from about 7 to about 8 mils. A particularly useful thickness range is from about 7.0 to about 7.6 mils. Here, as well as elsewhere in the specification and claims, the range and ratio limits may be combined.

Figure 1:
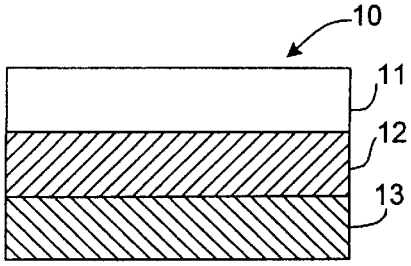
FIG. 1 is a cross sectional area of an article which may be pre-cut to make an article useful as a substrate for security printing.

Referring the Figures, FIG. 1, article 10 comprises facestock layer 11 bonded to one surface of the pressure sensitive adhesive 12. The other surface of the pressure sensitive adhesive is releasably bonded to release liner 13. The bond strength between the release liner and the pressure sensitive adhesive is greater than the strength of the temporary bonds between the ink and ink applicator during printing.

The facestock 11 may be paper or a polymer film, such as a thermoplastic film, e.g. polyolefin or polyvinyl chloride films. The facestock typically has a thickness with enough strength to be printable. In one embodiment, the facestock has a thickness from about 1.75 to about 7, or from about 2.5 to about 5, or from about 3 to about 4 mils. A particularly useful thickness is from about 3.1 to about 3.8. The paper facestock may be any paper stock, many of which are available commercially. The paper facestock, if intended for security applications, should be selected from those commercially available which have the weight and "feel" needed for the security application. An example of a useful paper facestock for stamp applications is available commercially from Westvaco as 60# C1S STAMP PAPER.

The pressure sensitive adhesive 12 may be any known pressure sensitive adhesive of the emulsion or non-emulsion type. Hot melt pressure sensitive adhesives may also be used. The pressure sensitive adhesive may be applied by any means know to those in the art. The pressure sensitive adhesive layer must be thick enough to provided a bond useful for security printing. The layer may have thickness up to the point where the adhesive does not pre-cut smoothly, i.e. the adhesive layer is stringy when cut. The pressure sensitive adhesive typically has a thickness from about 0.4 to about 1, or from about 0.5 to about 0.8, or about 0.6 mils.

As an example, the pressure sensitive adhesive may be applied as an emulsion by means such as is known. The adhesive may be acrylic or any other useful adhesive which has the hardness and adhesive properties needed for the security articles herein described. The adhesive should have a hardness sufficient to prevent the adhesive squeezing out of the article during processing. The adhesive hardness is affected by storage modulus ($0.45\times10^8$ dynes/cm$^2$ or higher), Tan delta (i.e. the ratio of the loss modulus to storage modulus, 1.46 or lower), glass transition temperature (−35 or −40° C.), anchorage to face, liner and lay flat.

A useful emulsion pressure sensitive adhesive is prepared by polymerizing alkyl acrylates, vinyl esters, diesters of dicarboxylic acids and unsaturated acids. The alkyl acrylates typically contain from about 2 to about 12, or from about 4 to about 8 carbon atoms in the alkyl group. Examples of alkyl acrylates includes ethyl, n-butyl, hexyl, 2-ethylhexyl, and isooctyl acrylates, with 2-ethylhexyl acrylate preferred.

The vinyl esters typically have from about 2 to about 12, or from about 4 to about 8 carbon atoms in the alkyl group. Examples of vinyl esters include vinyl acetate, vinyl propionate, vinyl butyrate, vinyl versitate and the like, with vinyl acetate being preferred.

The diesters of the dicarboxylic acids include alkyl esters of unsaturated diacids, such as maleic acid or anhydride and fumaric acids. The alkyl group generally contain from about 2 to about 20, or from about 4 to about 16, or from about 6 to about 12 carbon atoms. Examples of diesters of diacids include butyl,octyl fumarate; hexyl,decyl maleate; di-2-ethylhexyl maleate; di-butyl fumarate; and di-2-ethylhexyl fumarate and mixtures thereof.

The unsaturated acids generally contain from about 2 to about 12, or from about 2 to about 6 carbon atoms. Examples of the unsaturated acids include acrylic acid, methacrylic acid, itaconic acid, and the like.

In one embodiment, the alkyl acrylates are present in an amount of at least about 35%, or from about 35% to about 60% by weight. The vinyl esters are present in an amount from about 15% to about 35%, or from about 20% to about 25% by weight. The diesters of diacids are present in an amount from about 20% to about 35% by weight. The unsaturated acids are present in an amount up to 5%, or from about 1% to about 3% by weight. The pressure sensitive adhesives are described in U.S. Pat. Nos. 5,164,444; 5,183,459; and 5,264,532, all issued to Bernard, and U.S. Pat. No. 5,385,965, issued to Bernard et al. These patents are incorporated by reference for their disclosure of pressure sensitive adhesives, their components and methods of making the same.

As is described above the pressure sensitive adhesive 12 is releasable bonded to the release liner 13. The bond strength between the pressure sensitive adhesive 12 and the release liner 13 is greater than the temporary bonds formed between the ink and the ink applicator during printing. Typically the bond strength between the pressure sensitive adhesive 12 and the release liner 13 is at least about 50, preferably from about 50 to about 200, or from about 75 to about 175, or from about 100 to about 150 grams/2 inches. The bond strength is measured by determining the peel strength using the TLMI tester (Tag Label Manufacturing Institute). The method is described in United States Postal Specification USPS-P-1238 APPENDIX II Section 40.

The release liner 13 is composed of a release coating and a liner. The liner may be any useful liner which provides the strength and properties needed to provide support and release properties. The liner may be any liner know to be useful in security printing and stamp printing, such as paper or polymer film liners. An example of a useful liner is as 50# Point Special Release Liner—CPI Spec. #706 available commercially from Consolidated. This liner has a caliper from about 3.1 to about 3.7. In one embodiment, the caliper of the paper is sufficient to make the article die cut table. Liner calipers in the range from about 2 to about 5, or from about 3 to about 4 are considered useful. In one embodiment, the liner has lay flat properties. The liner has, in one case, a machine glaze or finish. The liners, in one embodiment, are not super calendered. The liner, in one embodiment, has a silicone hold out layer. This layer provides adhesion between the release coating and the release liner. The silicone hold out layer also prevents the silicone release coating from soaking into liner.

The release coating of the release liner provides the releasable bond with the pressure sensitive adhesive 12. The release coating may be any composition which provides the necessary releasable bond strength. In this invention the releasable bond is greater than the temporary bonds formed between the ink and the ink applicator during printing.

In one embodiment, the release coating is a silicone release coating. The release coating is prepared by curing silicone polymers in the presence of a control release agent. The control release agent is, in one embodiment, a copolymer of a monofunctional silicone unit of the formula $$R_3SiO_{1/2}$$

and tetrafunction silicones units $$SiO_{4/2}$$

wherein R is an alkyl or alkenyl group. In one embodiment, the alkyl or alkenyl groups contain from about 1 to about 12, or from about 1 to about 6 carbon atoms. Examples of alkyl and alkenyl groups include methyl, ethyl, propyl, butyl, hexyl, ethenyl, propenyl, butenyl and hexenyl groups.

The control release agent is reacted with a polysiloxane. The polysiloxane may be any polysiloxane which is useful in forming a release coating. Examples of useful polysiloxanes include vinyl terminated, hydroxy terminated and epoxy terminated polysiloxanes. In one embodiment, the polysiloxane is a functional polydialkyl siloxane, wherein the alkyl group contain from about 1 to about 6 carbon atoms. The alkyl groups independently include methyl, ethyl, propyl, butyl, pentyl, hexyl groups or mixtures thereof. In one embodiment, the alkyl or alkenyl group contains from 1 to about 12, or from 1 to about 6 carbon atoms. The polysiloxane typically has a viscosity average molecular weight of greater than 300,000 centipoise (cps). In another embodiment, the polysiloxane has a viscosity molecular weight from about 300,000 to about 1,000,000 or more. The polysiloxane may be represented by the formula $$RO((Si(R)_2O)_x)—Si)—R$$

wherein each R is independently as defined above and x is an integer.

The release coating, in one embodiment, is prepared with a cross linking agent. The cross linking agent is a reactive polysiloxane, such as a polydialkyl or polyhydroalkyl siloxane. The alkyl groups are the same as those described above.

The components of the silicone release coating are typically present in an amount up to about 40%, or preferably from about 50% to about 75% by weight of the solvent release coating. The polysiloxane is generally present in an amount of at least 21%, preferably from about 25% to about 50% by weight. The cross linking agent is present in an amount less than about 10% by weight. Typically, from about 20 to about 90, or from about 30 to about 70, or from about 40 to about 50 parts of polysiloxane are used for every part of catalyst. Generally, from about 35 to about 140, or from about 45 to about 110, or from about 60 to about 80 parts of control release agent are used with each part of polysiloxane. From about 50 to about 150, or from abut 75 to about 125, or from about 90 to about 110 parts of crosslinking agent are used for every part of polysiloxane.

The release coating may be applied in a solvent, solventless or emulsion form. The release coating may be cured by any known curing process, e.g. thermal, radiation, etc., to form the release coating. The curing may be catalyzed by silicone soluble complexed compounds of Group VIII transition metals, such as platinum.

An example of a commercially available control release agent is GE SS-4335, a silicone control release agent in unreactive solvent. An example of a useful polysiloxane is GE SS-4331, a vinyl terminated polydimethyl siloxane. An example of a useful cross linking agent is GE SS-4300C, a polymethyvinyl siloxane. An example of the catalyst is SS-8010 catalyst in toluene. These materials are available commercially from General Electric Company's Silicone Products Division. Similar silicone products are available under the Tradename Syl-off from Dow Corning Corporation.

The following example relates to a release coating which is useful in the present invention.

EXAMPLE

A release coating is prepared by mixing 273.4 parts of solvent (Tolusol-5 from Shell Oil Company, a mixture of 95% naptha and light aliphatics and 5% toluene) and 43.3 parts of SS-4331 Polysiloxane, a vinyl terminated dimethyl polysiloxane having a Brookfield viscosity of 1500–3000 cps (LTV#12 at 60 rpm) and 20% solids. To this mixture is added, in order: 0.78 part of SS-8010 catalyst, having a reactivity cure of 6 hours; 0.79 part of SS-4335 Control Release Additive, having a viscosity of 11–16 cps and 60% solids in toluene; 0.36 part of SS-4300C release coating catalyst, a methylhydrogen polysiloxane, having a viscosity of 15–40 cSk. The components are mixed for 5 minutes and then applied to the release liner.

The release coating may be applied to the liner by any means known to those in the art, such as rolling, spraying, brushing, dip-coating, etc. The silicone control release agents, the polysiloxanes, catalysts and methods of making and applying the same are described in U.S. Pat. Nos. 4,809,912, issued to Santini; 5,080,973, issued to Nguyen; and EP 108,208 of May 16, 1984. These patents are hereby incorporated by reference for these teachings.

Figure 2:
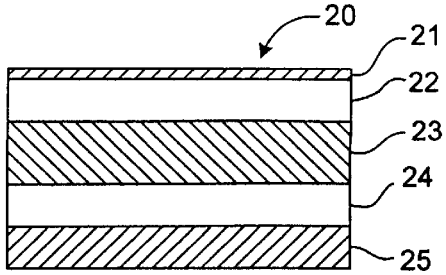
FIG. 2 is a cross sectional area of an article which may be pre-cut to make an article useful as a substrate for security printing.

Referring to FIG. 2, the article 20 has a printability coating 21 on facestock 22. The printability coating provides improved ink adhesion to the facestock. The printability coating includes, in one embodiment, calcium carbonate, clay, sulfur bromide and, if needed, zinc orthosilicate. Often the facestock is available commercially with the printability coating. The facestock 22 is bonded to pressure sensitive adhesive 23, which is releasably bonded to silicone coating 24 on release liner 25.

Figure 3:
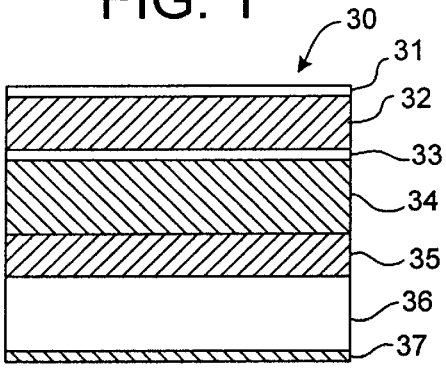
FIG. 3 is a cross sectional area of an article which may be pre-cut to make an article useful as a substrate for security printing.

Referring to FIG. 3, article 30 has printability coating 31 on facestock 32. Facestock 32 is bonded to water soluble primer coating 33, which is a water activated layer that provides for separation of the printed article from the pressure sensitive adhesive. The water soluble primer coatings are known to those in the art. The primer coat is of a nature which will allow the facestock of the stamp to be separated from the adhesive while still wet after soaking in water for 30 minutes and with slow peeling of the facestock of the stamp from the adhesive layer. The primer coating 33 is bound to pressure sensitive adhesive 34. Pressure sensitive adhesive 34 is releasably bound to release coating 35 on release liner 36. Release liner 36 has a printability coating 37 which may have a printed image thereupon.

Figure 4A:
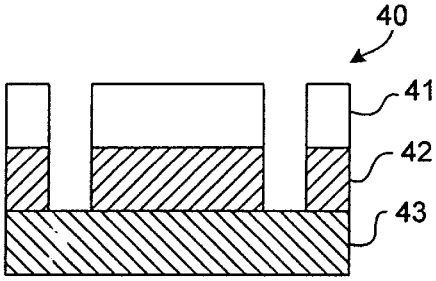
FIG. 4*a* is a cross-sectional area of an article which has been pre-cut through the facestock pressure sensitive adhesive and the release portion of the release liner.
Figure 4B:
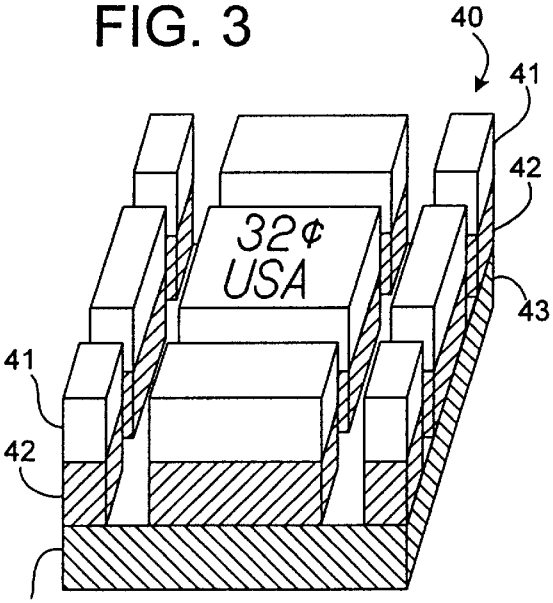
FIG. 4*b* is a view of an article which is pre-cut to in two directions to form peelable sections which may be printed as described herein.

As described above the article is pre-cut. Referring to FIG. 4*a,* shows pre-cutting of the article 40 through the facestock 41, pressure sensitive adhesive 42. FIG. 4*b,* shows pre-cutting the article, such as a sheet in two directions. As in FIG. 4*a,* the pre-cutting is accomplished through the facestock 41, and pressure sensitive adhesion 42.

Figure 5:
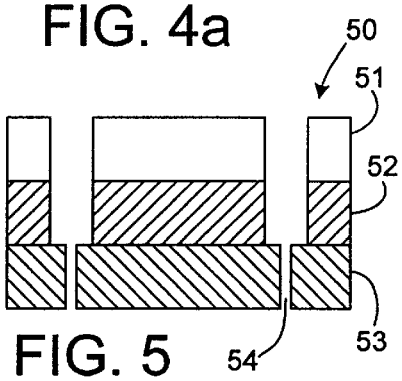
FIG. 5 is a cross sectional view of an article which is pre-cut through the facestock, pressure sensitive adhesive, and release portion of the release liner and perforated through the liner portion of the release liner.

FIG. 5 illustrates pre-cutting, which includes die cutting through the facestock 51 and pressure sensitive adhesive 52 and perforating to form perforation 54 through release liner 53. The perforation may be microperforation.

Figure 6:
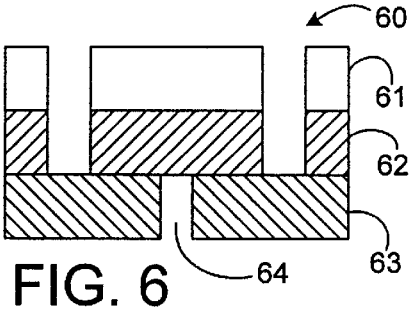
FIG. 6 is a cross sectional view of an article which is pre-cut through the facestock, pressure sensitive adhesive, and release portion of the release liner back cut and through the liner portion of the release liner.

FIG. 6 illustrates an article 60 which is pre-cut through the facestock 61 and pressure sensitive adhesive 62 and the back cut 64 through the release liner 63.

Figure 7:
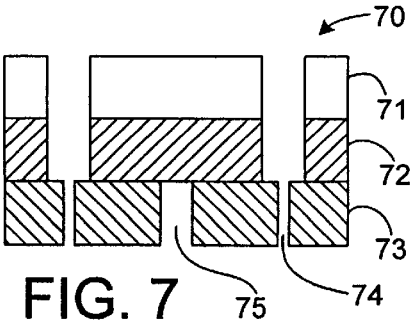
FIG. 7 is a cross sectional view of an article which is pre-cut through the facestock, pressure sensitive adhesive, and release portion of the release liner and back cut and perforated through the liner portion of the release liner.

FIG. 7, illustrates an article 70 which is pre-cut through facestock 71 and pressure sensitive adhesive 72 and both microperforated 74 and backcut 75.

Figure 8:
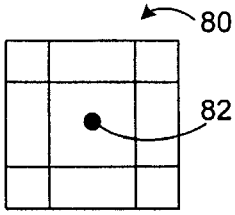
FIG. 8, is a top view of an article which is pre-cut and contains a registration system.
Figure 9:
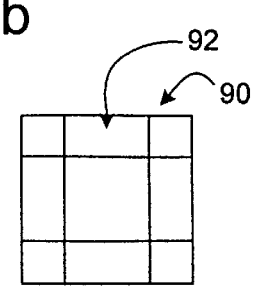
FIG. 9, is a top view of an article which is pre-cut and contains a registration system.

FIG. 8 illustrates an article 80 which is a sheet that is useful in security printing. The article 8 has registration system 82 which is a printed mark on the sheet. The security printing uses this mark to align the printing equipment. The registration system may be marks, notches, straight edges, etc. The registration system provides a means for printing with a deviation of about one sixty fourth of an inch or less. FIG. 9 illustrates an article 90 which has registration system 91 which is a notch. The registration may be an edge of square corner which has a deviation of less than 0.001 inches.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. An article useful as a substrate for security printing comprising a pre-cut facestock capable of being printed by offset, intaglio, gravure and lithograhic printing methods, a pressure sensitive adhesive having a first and second surface, and a release liner, wherein the first surface of the pressure sensitive adhesive is bonded to the facestock and the second surface is releasably bonded to the release liner, and wherein the bond strength of the releasable bond between the pressure sensitive adhesive and the release liner is greater than the temporary bonds formed with an ink and the ink applicator, wherein the ink is selected from the group consisting of offset, intaglio, gravure and lithographic printing inks and wherein the article has a registration system that serves as a guide for security printing.

2. The article of claim 1, wherein the facestock is paper.

3. The article of claim 1, wherein the facestock is a multilayer film laminate.

4. The article of claim 1 wherein the release liner has a silicone coating containing a control release agent.

5. The article of claim 4, wherein the silicone coating is derived by curing a silicone polymer with a control release agent and a crosslinking agent.

6. The article of claim 1 wherein the ink has a tack number of at least about 14.

7. The article of claim 1 wherein the releasable bond formed between the release liner and the pressure sensitive adhesive has a strength of at least about 50 grams.

8. The article of claim 1 wherein the registration system is a registration mark or a straight edge with a deviation of less than about 0.001 inch.

9. The article of claim 8 wherein the registration mark is a notch or hole.

10. The article of claim 1 wherein the article is die cut through the facestock and adhesive.

11. The article of claim 1 wherein the article is die cut through the facestock and adhesive and the liner is micro perforated.

12. The article of claim 1 wherein the article is micro perforated through the facestock, adhesive layer and liner.

13. The article of claim 1 wherein the article is die cut through the facestock and the adhesive layer, and the liner is back cut at a position offset from the die cut.

14. A die cut article useful as a substrate for security printing comprising a facestock capable of being printed by offset, intaglio, gravure and lithographic printing methods, a pressure sensitive adhesive having a first and second surface, and a release liner having a silicone coating capable of forming a releasable bond with the pressure sensitive adhesive of at least about 50 grams, wherein the first surface of the adhesive is bonded to the facestock and the second surface is releasably bonded to the release liner, wherein the bond strength of the releasable bond between the pressure sensitive adhesive and the release liner is greater than the temporary bonds formed with an ink and an ink applicator, wherein the ink is selected from the group consisting of offset, intaglio, gravure and lithographic printing inks, and wherein the article is die cut through the facestock and the pressure sensitive adhesive and the article has a registration system that serves as a guide for security printing.

15. The article of claim 14 wherein the article is printed with an ink having a tack number of at least about 15.

16. The article of claim 14 wherein the article has a registration system which is selected from the group consisting of a notch, a hole and a straight edge having a deviation of less than about 0.001 inch.

17. The article of claim 14 wherein the liner is micro perforated.

18. The article of claim 14 wherein the liner is back cut at a position offset from the die cut.

19. A security printing stock comprising a pre-cut paper facestock capable of being printed by offset, intaglio, gravure and lithographic printing methods, a pressure sensitive adhesive having a first and second layer and a release liner, wherein the first surface of the pressure sensitive adhesive is bonded to the facestock and the second surface is releasably bonded to the release liner, wherein the bond strength of the releasable bond of the pressure sensitive adhesive and the release liner is greater than temporary bonds formed with an ink, having a tack number of at least about 14, and the ink applicator, wherein the ink is selected from the group consisting of offset, intaglio, gravure and lithographic printing inks and the printing stock has a registration system that serves as a guide for security printing.

20. A method of making an article useful as a substrate for security printing comprising the steps of providing a facestock capable of being printed by offset, intaglio, gravure and lithographic printing methods, bonding a pressure sensitive adhesive to one surface of the facestock, forming a releasable bond on the other side of the pressure sensitive adhesive with a release liner, wherein the bond strength of the releasable bond is greater than temporary bonds formed with an ink and the ink applicator, wherein the ink is selected from the group consisting of offset, intaglio, gravure and lithographic printing inks, die-cutting the article and providing a registration system to the article that serves as a guide for security printing.

21. The method of claim 20 wherein the die cutting is through the facestock and the pressure sensitive adhesive.

22. The method of claim 21 further comprising the step of micro perforating the liner.

23. The method of claim 22 further comprising the step of back cutting the liner at a position off set from the location of the die cutting.

* * * * *